United States Patent [19]

Tsuji et al.

[11] Patent Number: 4,565,916

[45] Date of Patent: Jan. 21, 1986

[54] ELECTRIC HAIR CURLING IRON WITH ROTATABLE POWER CORD

[75] Inventors: Eiji Tsuji, Hikone; Akio Gotou; Kuniharu Ichikawa, both of Kyoto, all of Japan

[73] Assignee: Matsushita Electric Works, Ltd., Osaka, Japan

[21] Appl. No.: 428,660

[22] Filed: Sep. 30, 1982

[30] Foreign Application Priority Data

Nov. 25, 1981 [JP] Japan ..... 56-191075

[51] Int. Cl.[4] ..... A45D 1/04; H05B 3/00

[52] U.S. Cl. ..... 219/225; 132/9; 132/11 R; 132/34 R; 132/37 R; 219/230; 219/243; 219/533; 339/8 R; 339/58

[58] Field of Search ..... 219/222–226, 219/230, 243, 533; 156/579; 132/9, 11 R, 117, 118, 37 R, 37 A, 31 R, 32 R, 34 R; 339/8 R, 8 P, 58

[56] References Cited

U.S. PATENT DOCUMENTS

| | | | |
|---|---|---|---|
| 325,515 | 9/1885 | Elzenheimer | 132/37 R |
| 542,216 | 7/1895 | Allen | 219/225 X |
| 1,449,632 | 3/1923 | Talbot | 219/225 X |
| 1,898,467 | 2/1933 | Rochat | 219/225 X |
| 2,441,817 | 5/1948 | Huff | 219/230 X |
| 3,752,017 | 8/1973 | Lloyd et al. | 219/230 X |

FOREIGN PATENT DOCUMENTS

| | | | |
|---|---|---|---|
| 542359 | 11/1955 | Belgium | 219/243 |
| 1065401 | 1/1954 | France | 219/225 |
| 680650 | 10/1952 | United Kingdom | 219/230 |

*Primary Examiner*—A. Bartis

*Attorney, Agent, or Firm*—Stevens, Davis, Miller & Mosher

[57] ABSTRACT

An electrically heated hair curling iron has first and second handles pivotally connected at one end for movement toward and away from each other. Supported on the free ends of the handles are an electrically heated rod and a press plate which respectively project outwardly from the free ends. A electric power supply cord is connected to the electrically heated rod by a rotatable connector formed as a protrusion on one of the pivotally connected ends of the handles on the opposite side of the handles from the free ends thereof. The axis of rotation of the connector is coaxial with the centerline between the two handles and is in the same plane as the pivotal connection between the handles. Thus the iron can be easily rotated without twisting the power cord. The iron has an adjustment to regulate the opening angle of the handles and a releasable lock for securing the handles together in closed condition. One of the handles may be provided with side covers which serve to close the gap between the handles when they are moved apart and which act as legs to support the iron on a surface when the handles are closed.

13 Claims, 18 Drawing Figures

FIG. 5
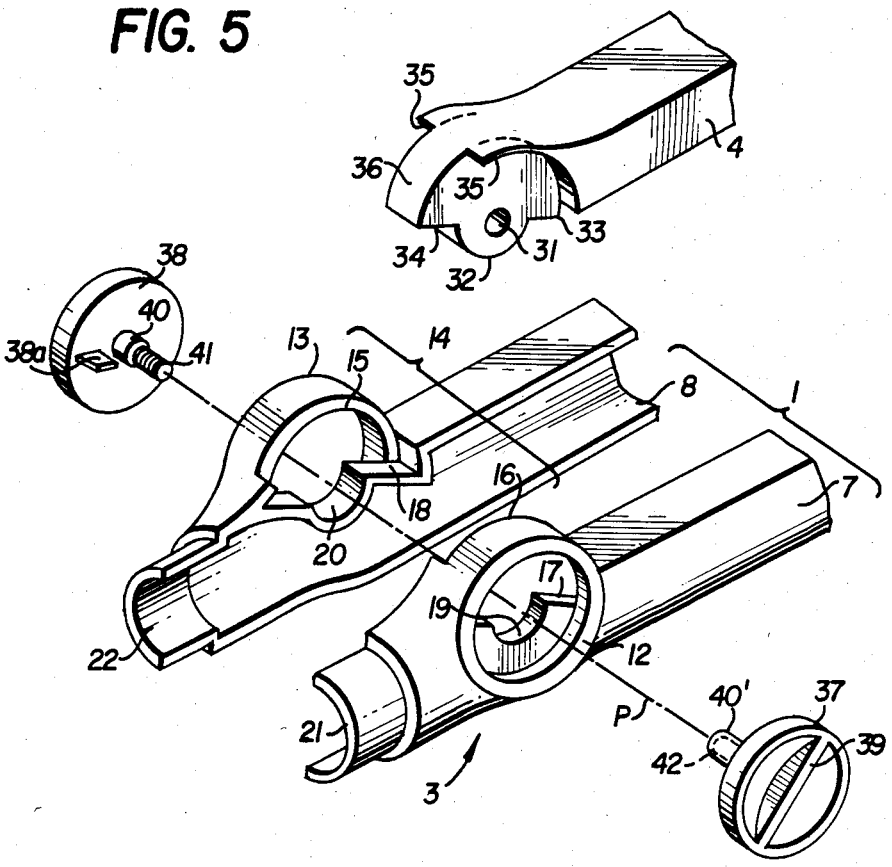
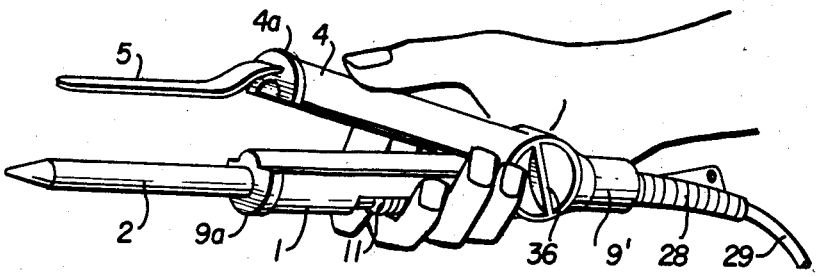
FIG. 6

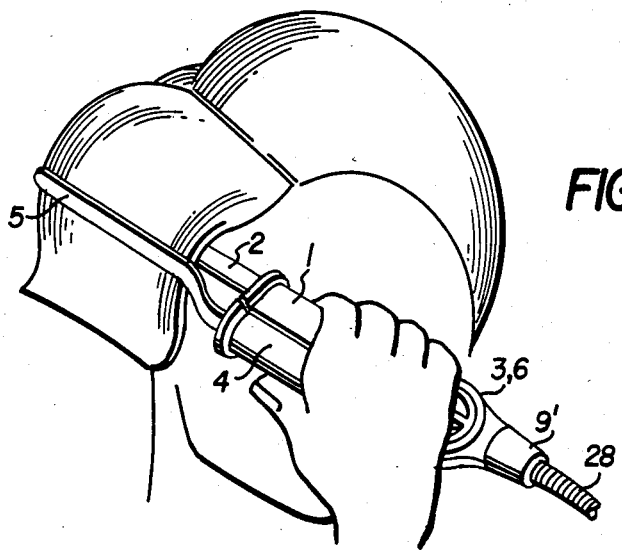
FIG. 7
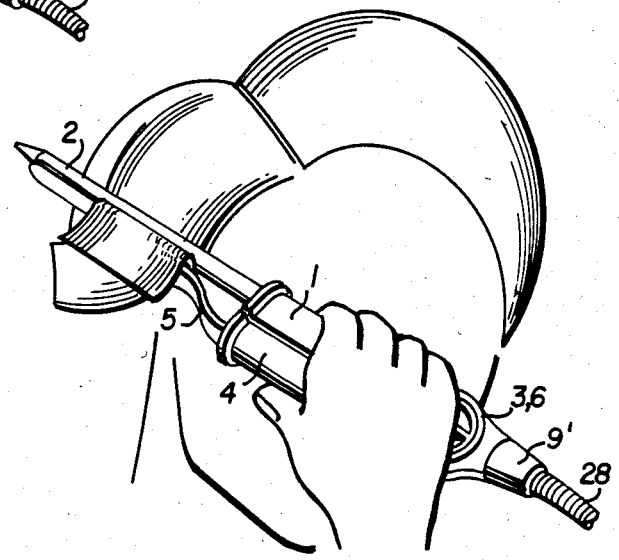
FIG. 8
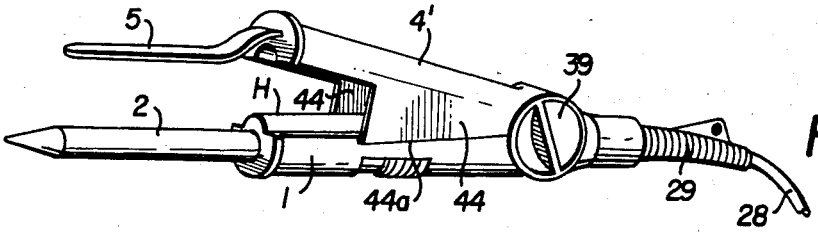
FIG. 9
FIG. 10
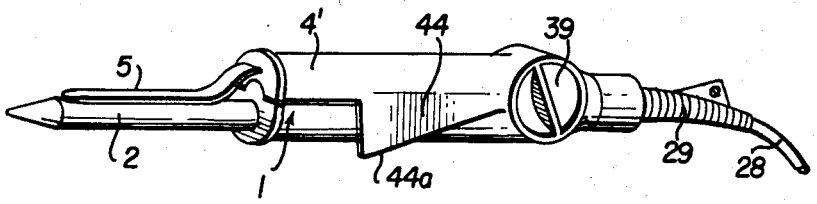

ELECTRIC HAIR CURLING IRON WITH ROTATABLE POWER CORD

BACKGROUND OF THE INVENTION

This invention relates to a hair iron sometimes called a curling iron.

A conventional scissors-like-shaped hair iron, as shown in FIGS. 11 through 13, is held by a user at a holder B connected to a power supply cord A and opened and closed by a handle C, thereby enabling relative pivotal motion between heater rod E and hair press plate F around the fulcrum D.

Preferably such a hair iron should, during hair curling, enable one manually to open the iron to a greater extent than is now possible. It would be preferably to make a greater opening "a" between the open ends of heater rod E and hair press plate F, and to make it easier to open or close the iron. However if the heater rod E and hair press plate F are further apart, it causes difficulty in curling short hairs. The handle C, when made shorter in length, can make it easier to enlarge the open dimension a, but such a shorter handle C is inconvenient for opening and closing. Furthermore, when the hair press plate F and heater rod E hold hair therebetween to be rotated and curled, the power supply cord A moves in a larger circle, making it difficult to use the iron.

Accordingly, an object of the invention is to provide a hair iron capable of an enlarged opening between the tips of the hair press plate and heater rod, to facilitate the opening and closing of the iron, thereby making it convenient to handle.

Another object of the present invention is to provide a V-shaped curling iron with a spring biasing it open and with a locking means. That means requires a relatively small holding force and ease of operation is improved without obstructing the hair to be wound on the iron.

A further object of this invention is to provide a curling iron having a rotary cord connection located on the longitudinal center line between the two handles thereof so as to avoid twisting of the power cord when rotating the curling iron.

RELATED PRIOR ART

U.S. Pat. No. 2,866,468 issued Dec. 30, 1958 to Francis E. Eldridge and U.S. Pat. No. 4,040,696 issued Aug. 9, 1977 to Yukio WADA et al are related prior art.

BRIEF DESCRIPTION OF THE DRAWINGS

FIG. 5 is a perspective exploded view showing the pivot portions;

FIG. 6 is a perspective view showing the hair iron in a user's hand;

FIGS. 7 and 8 are perspective views showing the hair iron in use;

FIG. 9 is a perspective view of a second embodiment of the invention while open;

FIG. 10 is a perspective view of the second embodiment while closed;

DETAILED DESCRIPTION OF THE INVENTION

Figure 1:
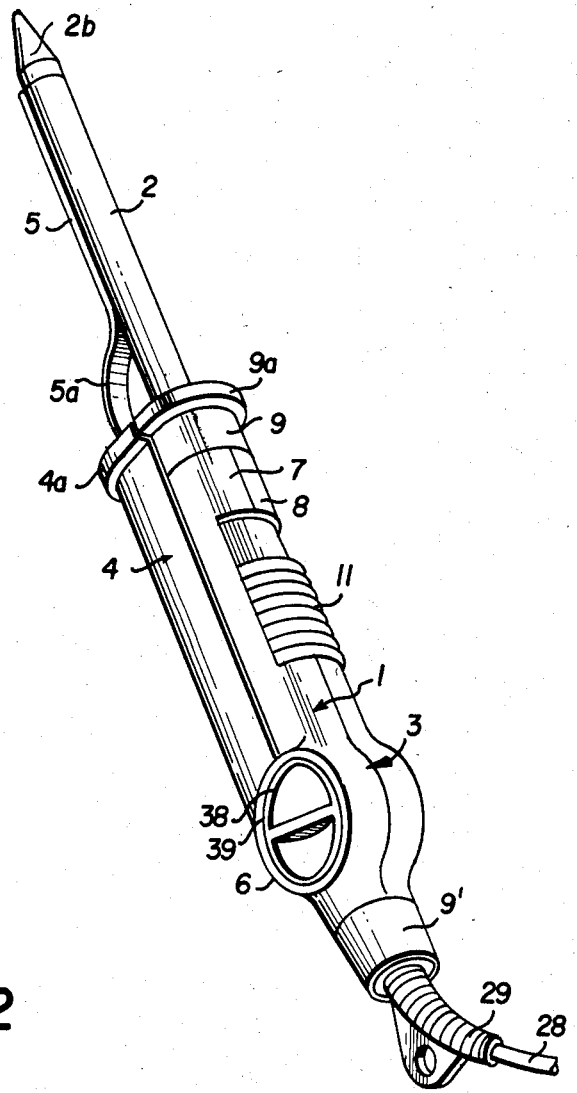
FIG. 1 is a perspective view of a first embodiment of the invention when closed.
Figure 2:
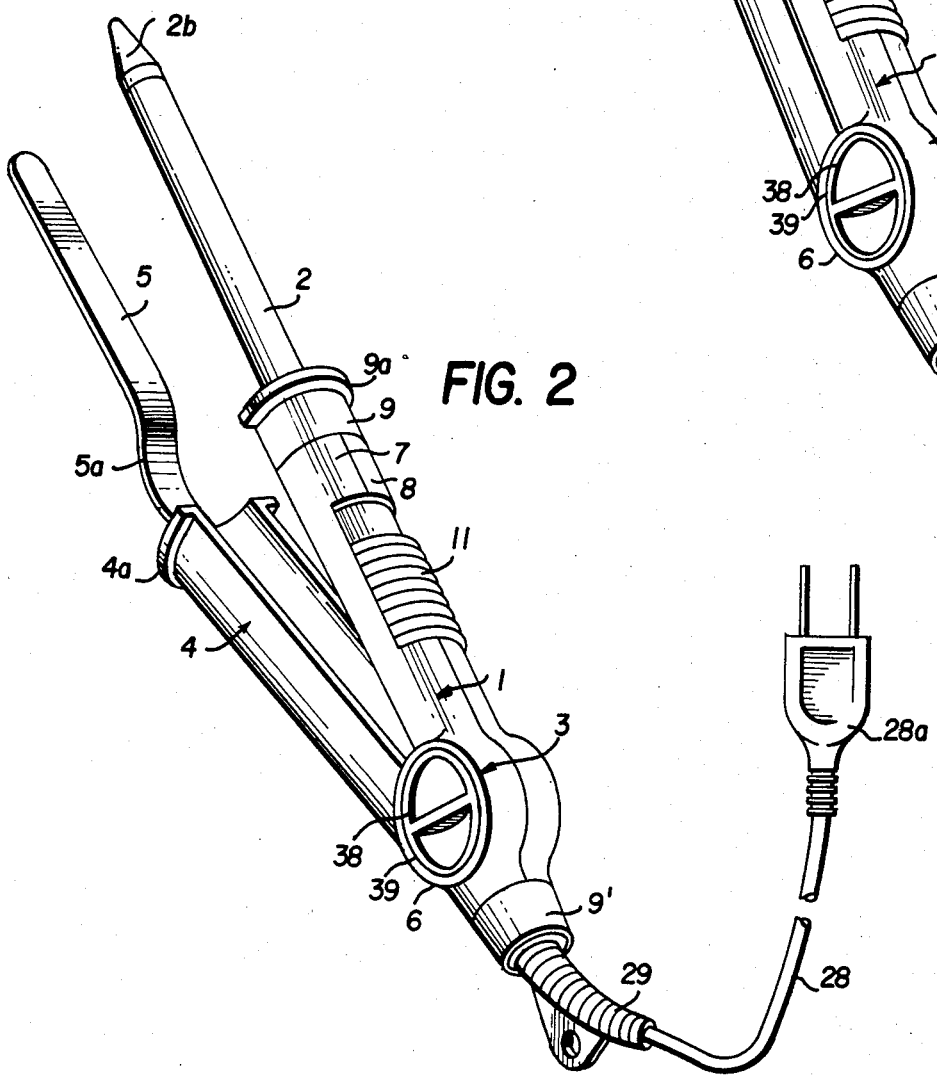
FIG. 2 is a perspective view of the first embodiment when open.
Figure 3:
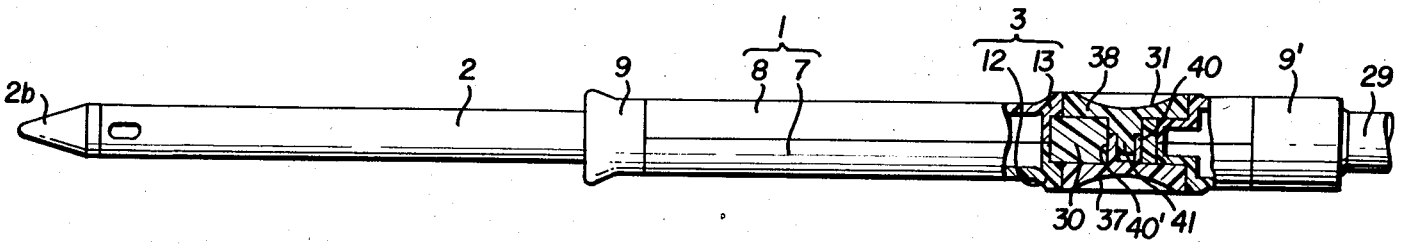
FIG. 3 is a partial sectional top view of the first embodiment.
Figure 17:
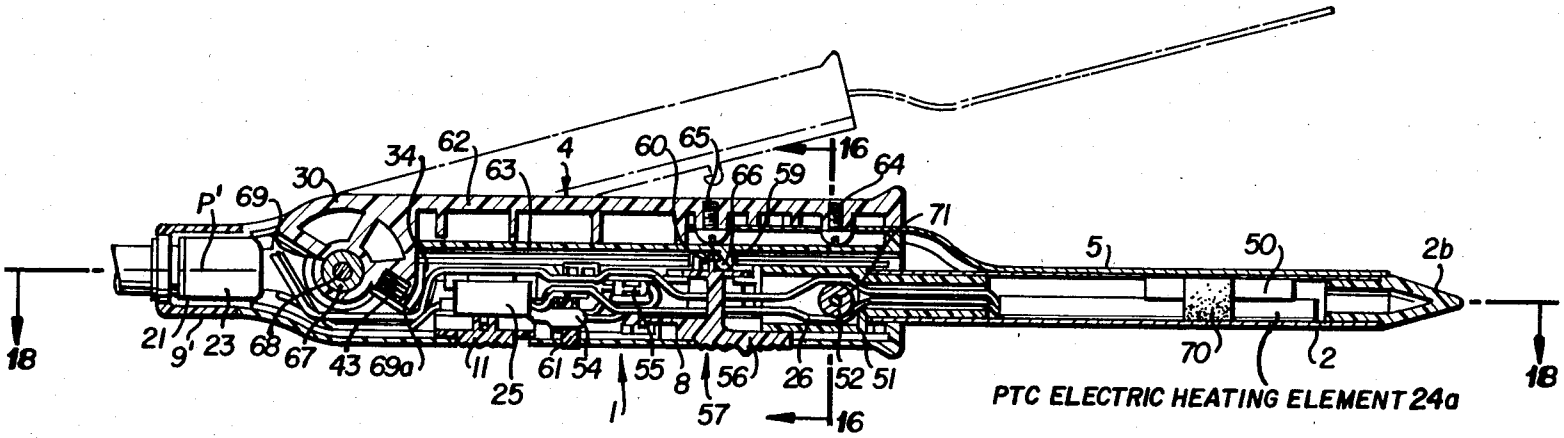
FIG. 17 is a longitudinal cross-sectional view of the hair iron of FIG. 14; and, FIG. 18 is a cross-sectional view on line 18—18 of FIG. 17.
Figure 18:
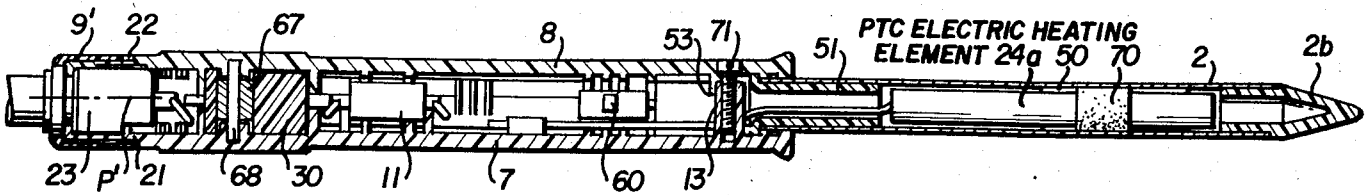

A first embodiment of the invention is shown in FIGS. 1 through 8. The hair iron of the invention is characterized in that a first handle 1 has at the distal end thereof a heater rod 2 having a cap **2*b* and has at its proximal end a pivot portion 3. A second handle 4 of equal size to the first handle 1 has at its distal end a hair press plate 5. Handle 4 has at its proximal end a pivot portion 6; pivot portions 3 and 6 are connected pivotally to each other. The first handle 1, as shown in FIGS. 3 and 5, comprises a pair of members 7 and 8 fitted lengthwise to each other so as to form a tubular body, the members 7 and 8 forming at their ends a mounting end 2*a* for heater rod 2 and embracing it, so that the heater rod 2 can be held by a cap 9. The cap 9 has a flange 9*a* on the heater rod side near its end. A bore 10 is formed at a lengthwise intermediate portion of the handle 1 and a switch handle 11 in the bore 10 is slidably lengthwise of the handle 1. the members 7 and 8 have at their proximal ends annular portions 12 and 13 defining opening therethrough having a common axis P (in FIG. 5). The annular portions 12 and 13 are provided on their facing sides with cutouts 15 and 16 which, when assembled, form an opening 14 on one side of handle 1. Supports 17 and 18, which are positioned on the inside of opening 14 and partition about half of each annular portions 12 or 13, have semicircular recesses 19 and 20 coaxial with axis P, thereby forming the pivot portion 3. At the rear side of annular portions 12 and 13 are protrusions 21 and 22, which are semicircular in cross-section with their axis P' as shown in FIGS. 17 and 19 perpendicular to the axis P and parallel to the length of handle 1. The protrusions 21 and 22 encompass a rotary cord connector 23 which is covered by a snap ring 9', thereby integrally holding the members 7 and 8 together at their proximal ends. A PTC resistance heating element 24 is housed in heater rod 2 and a switch 25 is mounted within the handle 1 under switching handle 11 and engaged therewith, so that the heating element 24 and switch 25 connect with the load side terminals of rotary connector 23 through lead wires 26 and 27. The rotary connector 23 connects with a power supply cord 28 through a flexible bush 29, whereby the switch 25 is connected to control PTC heating element 24**.

Figure 4:
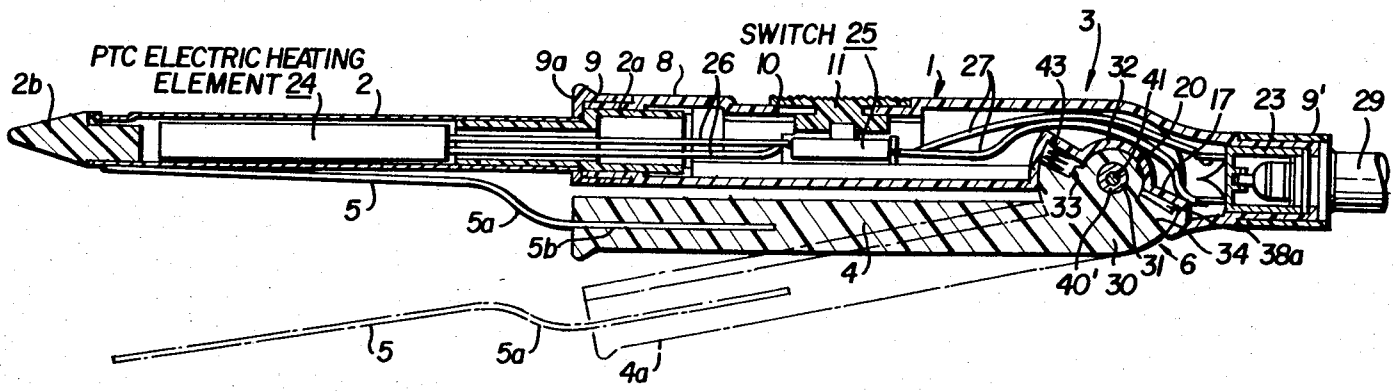
FIG. 4 is a sectional view of the hair iron of FIG. 3.
Figure 11:
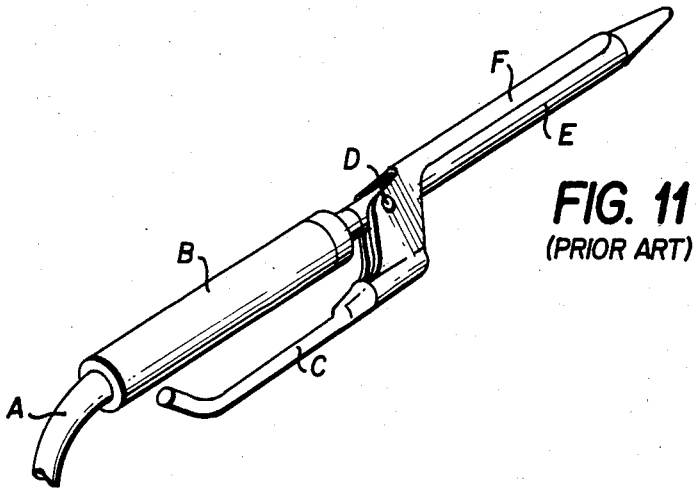
FIG. 11 (PRIOR ART)
FIGS. 11 through 13 are perspective views exemplary of a prior art hair iron.
Figure 12:
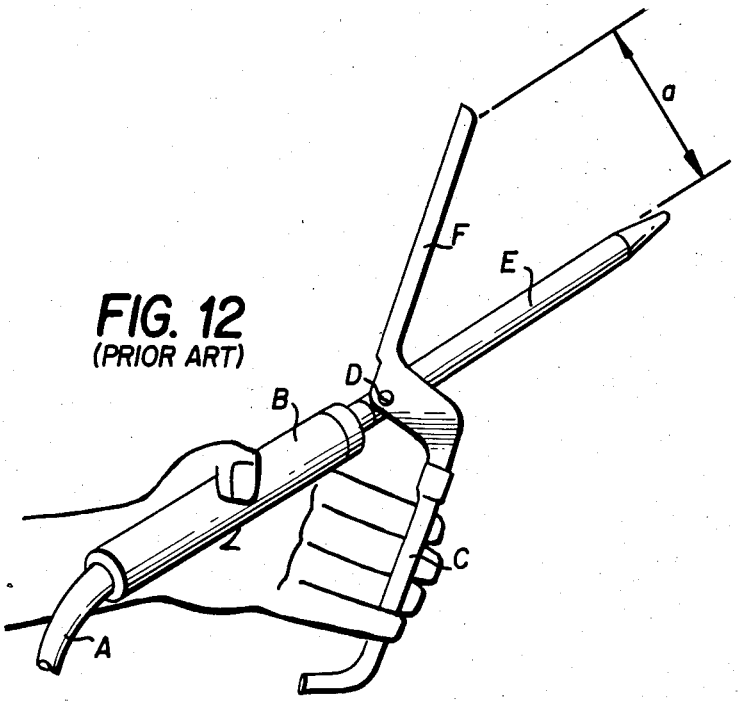
FIG. 12 (PRIOR ART)
Figure 13:
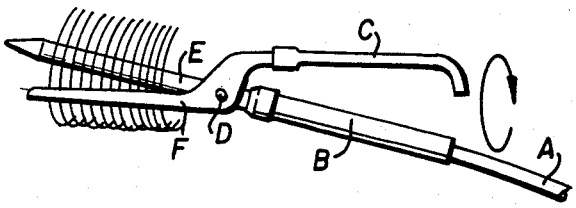
FIG. 13 (PRIOR ART)
Figure 14:
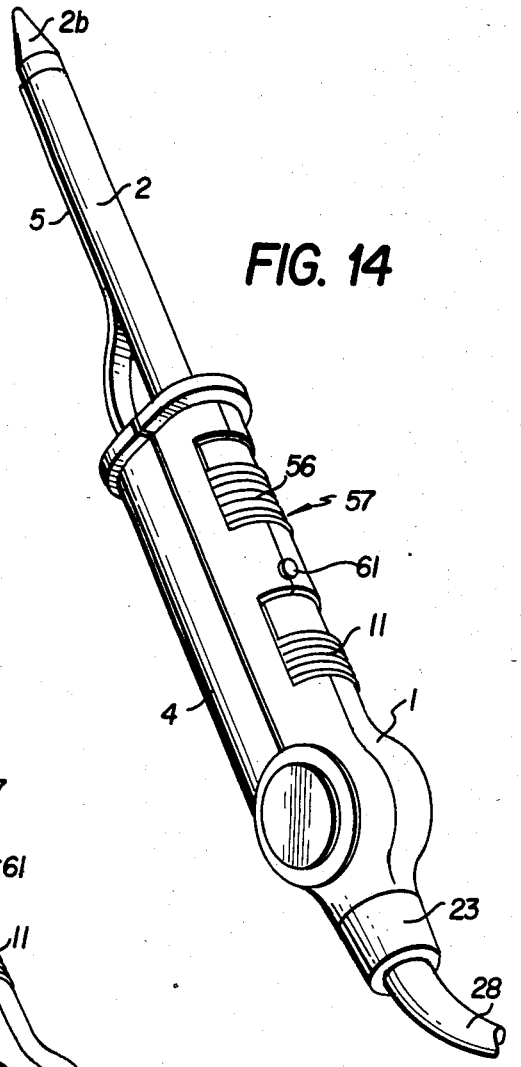
FIG. 14 is a perspective view of a third embodiment of the invention.
Figure 15:
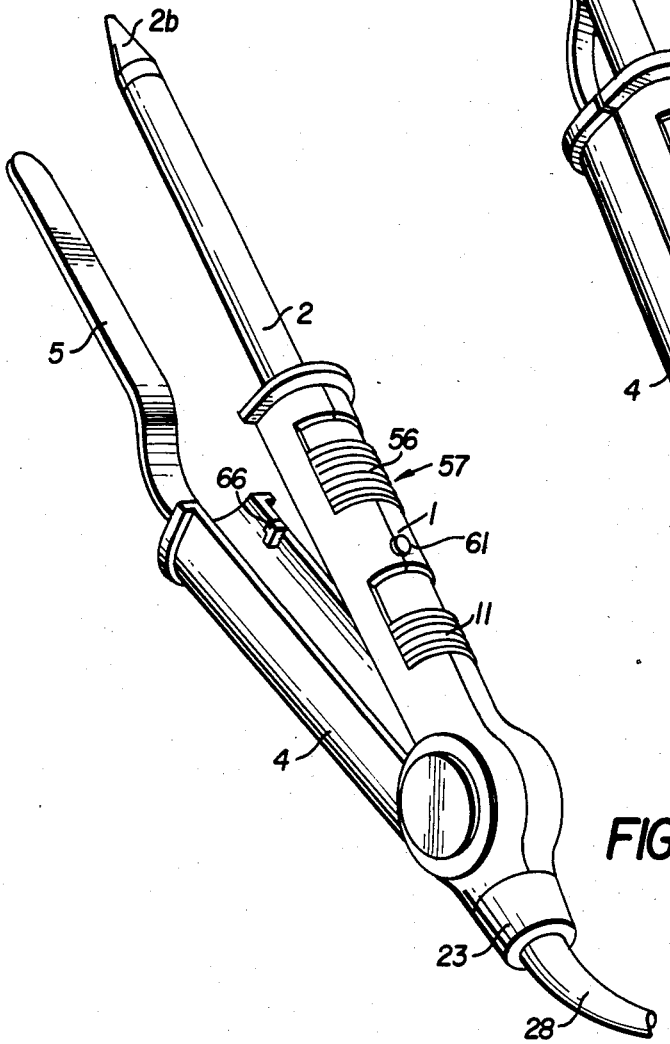
FIG. 15 is a perspective view of the embodiment of FIG. 14 when it is opened.
Figure 16:
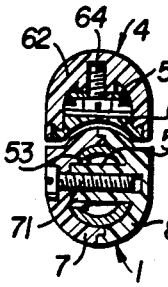
FIG. 16 is a cross-sectional view on the line 16—16 of FIG. 17.

On the other hand, the second handle 4 supports at its distal end one end **5*b* of a Z-like-bent stepped portion 5*a* of plate 5. End 5*b* is molded into handle 4 which has a flange 4*a* projecting therefrom and is shaped to be a continuation of the flange 9*a*, so that the heater rod 2 is adapted to blend in and be a part of the surface. The proximal end of handle 4 is formed with a fitting portion 30 of a width corresponding to opening 14, the fitting portion 30 having at a predetermined position a shaft bore 31 extending through fitting portion 30, and having a semicircular projection 32 of an outer diameter equal to an inner diameter of each recess 19 or 20. Also, the fitting portion 30 has end faces 33 and 34 as continuations of both radial sides of projection 32, the end faces 33 and 34 being positioned radially rearwardly of the axis P as shown in FIG. 4 and sloping at predetermined angles. At the radially outer edge of handle 4 of fitting portion 30 are formed guides 35 (see FIG. 5) which are concave and of a curvature equal to the outer diameter of each annular portion 12 or 13 and have arcuate surfaces 36 of the same curvature as the above, thereby forming a covering over connecting portion 6 of second handle 4 with first handle 1**.

The first and second handles 1 and 4 are pivoted to a pair of pivot pins 37 and 38, which each have an outer diameter equal to an inner diameter of each annular portion 12 or 13 of handles 1 or 4 and an axial length large enough to be fitted into each annular portion 12 or 13 and also have at their outer axial surfaces knobs 39 for rotating the pins 37 and 38 respectively. One pivot pin 38 has at the center of its inner surface a boss 40 projecting therefrom which is sized to be fitted rotatably into the shaft bore 31, the boss 40 having at its end a male threaded rod 41 projecting therefrom. A projection 38*a* is provided at a predetermined position on the inner surface of guide ring 38. The other pivot pin 37 has on its inner surface a boss 40' similar to the boss 40 except for female threaded bore 42 in the end of boss 40'.

The hair iron of the invention is so assembled that the fitting portion 30 of second handle 4 is fitted into the opening 14 of the first handle 1 and the semicircular projection 32 of second handle is received in the recesses 19 and 20. A compression coil spring 43, as shown in FIG. 4, is interposed between the upper surface of one support 17 or 18 and the end face 33. The pivot pins 37 and 38 are inserted into the annular portions 12 and 13, and the bosses 40 and 40' of pins 37 and 38 are passed through the shaft bore 31 and the pivot pins 37 and 38 are threaded together, thereby tightening the pivot pins 37 and 38 to the support 17 and 18 respectively. Hence the pivot pins 37 and 38 are then fixed integrally to each other. The second handle 4 pivots about the bosses 40 and 40' in the direction of opening the handle 4 (see FIG. 2) and the rotational movement of the other end face 34 of the fitting portion 30 is limited by the projection 38*a* of pivot pin 38. To accomplish adjustment, the pivot pins 37 and 38 are unscrewed a little to rotate and slightly shift circumferentially the projection 38*a* (the pivot pin 38 is positioned to tighten the pivot pin 39), whereby the travel of second handle 4 is adjusted to vary the degree of opening. The projection 38*a* is rotated to seat against support 17 (see FIG. 4) to permit maximum opening or can be positioned to lock the handle 4 so that there is no opening distance between heater rod 2 and hair press plate 5 by seating against surface 34 when closed.

FIGS. 6 through 8 show the hair iron of the invention in use. At first, the power supply cord 28 is connected by its plug 28*a* to a suitable receptacle, the switch handle 11 is turned on, and the hair iron is placed on a mount, so that the heater rod 2 and hair press plate 5 are heated while being suspended above the surface of the mount by means of flanges 4*a* and 9*a* and annular portions 12 and 13. The hair press plate 5, which contacts the heater rod 2 through its stepped bent portion 5*a*, is rapidly heated. A user, as shown in FIG. 6 grips the first handle 1 with the fingers or palm of his hand and tends to push second hadle 4 with his thumb. Since the hair press plate 5 is biased open by the spring 43, he can push the second handle 4 with his thumb and close it. Thus, in a case of inwardly waving the hair as shown in FIG. 7 or of outwardly waving it as shown in FIG. 8, the user puts into the user's hair the heater rod 2 or hair press plate 5 while holding the iron open and then he pushes with his thumb the second handle 4 to hold the hair and rotate the iron as a whole, thereby curling his hair. In addition, during the rotation, the rotary connector 23 is positioned at the center of rotation to avoid the swinging motion of power supply cord 28.

The hair iron of the invention constructed as foregoing is effective in operation as follows:

(1) Because the handles 1 and 4 are pivoted at their extreme ends one can enlarge the opening and the amount of hair within press plate 5 without increasing the length of the heater rod 2, and because of the above, the handles 1 and 4 are required to open to a lesser extent, whereby the hair iron is easy to hold and convenient to handle. Accordingly, the hair iron, even if the heater rod 2 is shorter in length, can open the tip of hair press plate 5 wide enough to facilitate curling of even short hair. The iron is easy to use in comparison with a conventional one, because the hair press plate 5 is operated in the same direction as the user's hand movement;

(2) Since the rotary connector 23 is at the center of rotation of handles 1 and 4, the power supply cord 28 does not swing in a circle during the hair-curling, thereby making it easy to rotate and to curl the hair;

(3) Since the rotary connector is on the end of the first handle 1, the installation of the switch 25 and its connection can be done during the assembly of first handle 1, thereby facilitating assembly; and, (4) The projection 38*a* on pivot pins 37 or 38 serves to enable adjustment of the angle of opening of hair press plate 5 and locking thereof.

Next, a second embodiment of the invention is shown in FIGS. 9 and 10, in which a second handle 4' has covers 44 extending longitudinally from both sides of handle 4' toward first handle 1 so as to close gap H between the handles 1 and 4' when open, thereby preventing the user's fingers or his palm from being caught or pinched in the gap H. Also, the covers 44, when in the locking condition as shown in FIG. 10, project from the inner side of first handle 1, thereby the edges 44*a* of cover 44 serve as legs to prevent the hair iron from rolling when placed on a flat surface or a stand.

In addition, the cover 44 may be formed as a bellows of folded or stretchable sheet material.

The hair iron of the invention also may include an iron having no spring 43. The heater rod may include a steam setting means.

As seen from above, the hair iron having its first handle supporting the heater rod and the second handle supporting the hair press plate, which are pivoted at their extreme ends, can open the hair press plate with respect to the heater rod to a greater extent without the need for a longer heater elongating the rod, thereby easily holding hair and being convenient to use.

A third embodiment of the invention is shown in drawings FIGS. 14–18. The parts thereof bear reference numerals corresponding to those of the first embodiment.

The heater rod 2 consists of a metal tube and a cap 2*b* that crowns the end of the tube. The heater rod 2 contains an internally mounted PTC heater 24*a* which utilizes a positive temperature factor thermistor and a heat sink 50, both being wrapped as one body with a heat resistant tape 70. A supporting tube 51 of a different diameter fits on the handle end of the heater rod 2, and the one end of this supporting tube 51 fits into the distal end of the first handle 1. The first handle 1 consists of two halves 7 and 8. Both halves are fixed together as one body by matching internal bosses 52 and 53 which also hold said supporting tube 51 by a clamping fit on it and be screw 71. A pilot lamp 54 and a current limiting resistance 55 are at the load side of the switch 25. Further downstream of those, that is, at a position towards the distal end of the first handle 1 and spaced from shaft 68, a locking button 56 of a locking means 57 is provided. The locking button 56 can slide longitudinally on the first handle 1 a hole 59 is formed on the opposite side of the handle, and an elastic hook 60 that extends from the locking button 56 is positioned in the hole 59. A transparent window 61 for the pilot lamp 54 and a lead wire 26 and a power cord 28 extending out of the rotating connector 23 are provided.

The hair pressing plate 5 is of circular arc cross-section with radius of curvature equal to or larger than the outer diameter of the heating rod. Its rear end is bent upward, so that, when it is pressed on the heater rod 2, it contacts the distal end of the rod 2 first, after which contact progresses to the rear end of the rod 2 until rod and plate are in complete contact. The contact is therefore a flexible contact. The rear end of the plate 5 is attached to the distal end of the second handle 4. The second handle 4 consists of the main body 62 and its cover 63. At the front end of the main body 62 the hair pressing plate 5 is held with a pair of self tapping screws 64 and 65 and covered by the main body cover 63. The surface of the main body cover 63 has a protrusion 66 that engages the hook 60. The rear end of the second handle 4 is also provided with a bearing 67. A shaft 68 fits into the bearing 67 which is positioned in the opening 69 of the first handle 1 when the first handle 1 is fitted thereon, and the coil spring 43 is placed between the bottom 69*a* of the opening 69 and a flat face 34 on handle 4 that fits in the opening 69 of the first handle 1. In this way the first handle 1 and the second handle 4 are connected rotatably by the shaft 68, and both are urged to open by means of the spring 43. At the same time the lock button 56 of the locking means 57 slides to engage and disengage the engaging protrusion 66 with the elastic hook 60 when opening and closing the first and second handles 1 and 4.

The curling iron generates heat as previously described by connecting the plug and turning on the power switch 11 which lights the pilot lamp 54 and supplies power to the heater 24. During use, the first handle 1 and the second handle 4 are grasped in one hand. Then the hair pressing plate 5 contacts the heater rod 2. Now, the lock button 56 is slid to engage the elastic hook 60 with the engagement protrusion 66. When the heater rod 2 reaches a specified temperature, the locking button 56 is moved to unlock, and the first handle 1 and the second handle 4 are separated by the driving force of the spring 43. Next, the heater rod 2 and the hair pressing plate 5 are inserted into the hair, and the handles 1 and 4 are grasped in the hand to compress the hair between the heater rod 2 and the hair pressing plate 5, and the locking button 56 locks the curling iron to hold the hair while the curling iron is rotated to wind the hair on to it, said hair being held for several seconds.

The power switch 11 is turned off to turn off the heater 24 and the hair iron can be stored by locking it again with the locking means 57.

Note that since the hook 60 of the locking button 56 is formed of a flexible material, it engages the button 56 with the engagement protrusion 66 even if the locking button is in the locking position to close the handles 1 and 4. Note, too, that the handles 1 and 4 can be forced open owing to this flexibility without releasing the locking button 56. Thus, even abnormal handling will not damage the engagement protrusion 66 and the hook 60. As a modification of the invention, the engagement protrusion can be made of a plastic material.

In the above description, note that the curling iron according to the invention is V-shaped with a spring drive for opening, and is provided with a locking means on the top of the handle, said arrangement making it easy to use the curling iron, and the curling iron can be locked with relatively little engaging force, because the locking means is positioned away from the rotating center. Because the locking means is not at the front end of the heating rod, it does not obstruct the incoming hair. A further aspect of this embodiment is that the engagement protrusion or the hook can be formed of a flexible material so as to avoid damage if the handles are forced opened with the locking means in the locking position.

What is claimed is:

1. A hair iron comprising:

(a) first and second elongated handles pivotally connected together adjacent an end of each;

(b) a heating means comprising an electric heater rod secured to and projecting outwardly from the free end of said first handle;

(c) a hair press plate secured to and projecting outwardly from the free end of said second handle so as to be pivotally contactable with said heater rod; a power cord for supplying power to said electric heater rod;

(d) a rotary connector connected to said power cord adjacent the pivotal connection of said first and second handles, said connector being formed as a protrusion on one of said pivotally connected ends of said first and second handles on the opposite side of the pivotal connection of the first and second handles from the free ends thereof and being coaxial with a longitudinal center line between the two handles and the axis of rotation of the rotary connector being also in substantially the same plane as siad pivotal connection between the handles, and means connecting said rotary connector to said heater rod.

2. The hair iron of claim 1 in which said rotary connector protrusion projects from said first handle, said first handle housing electrical parts comprising said means electrically connecting the said rotary connector to the heater rod.

3. The hair iron of claim 1, in which said hair press plate is devoid of a heating means.

4. The hair iron of claim 1, in which said rotary connector protrusion comprises two semicircular projections which encompass a rotatable cylindrical member fitting therein and having its axis of rotation substantially on said longitudinal center line between the two handles so that when said cylindrical member is rotated, the rotation takes place substantially along said longitudinal center line, said cylindrical member forming part of the rotary connection between said power cord and said heater rod.

5. The hair iron of claim 4, in which said one of said handles bearing the protrusion comprises two parts joined along a longitudinal joint and said semi-circular projections are carried one by each said parts.

6. A hair iron comprising:

(a) first and second elongated handles pivotally connected together adjacent an end of each handle for rotation about a first axis and a spring between said first and second handles tending to bias them away from each other;

(b) a heating means comprising an electric heater rod secured to and projecting outwardly from the free end of said first handle;

(c) a hair press plate secured to and projecting outwardly from the free end of said second handle so as to be pivotally contactable with said heater rod; a power cord for supplying power to said electric heater rod;

(d) a rotary connector connected to said power cord adjacent the pivotal connection of said first and second handles, said connector being formed as a protrusion on one of the pivotally connected ends of said first and second handles, the axis of rotation of said connector being coaxial with a longitudinal center line between the two handles and also in substantially the same plane as said first axis and means connecting said rotary connector to said heater rod.

7. The hair iron of claim 6 including means on the handle to regulate the opening angle between said handles.

8. A hair iron comprising:

(a) first and second elongated handles pivotally connected together adjacent an end of each for movement toward and away from each other and cooperating means on facing surfaces of said handles for releasably locking said first and second handles together in a closed state;

(b) a heating means comprising an electric heater rod secured to and projecting outwardly from the free end of said first handle;

(c) a hair press plate secured to and projecting outwardly from the free end of said second handle so as to be pivotally contactable with said heater rod; a power cord for supplying power to said electric heater rod;

(d) a rotary connector connected to said power cord adjacent the pivotal connection of said first and second handles, said connector being formed as a protrusion on the pivotally connected end of one of said first and second handles, the axis of rotation of said rotatable connector being coaxial with a longitudinal center line between the two handles and also in substantially the same plane as said axis of rotation and means connecting said rotary connector to said heater rod.

9. The hair iron of claim 8 in which said locking means comprises an engagement part on one of the facing surfaces and a free sliding hook on the other facing surface, at least one of the engagement part or hook being made of a flexible material.

10. A hair iron comprising:

(a) first and second elongated handles pivotally connected together adjacent an end of each handle for rotation toward and away from each other about a first axis and covers extending from the sides of one of said handles toward the other of said handles, said covers being positioned to cover the gap between the handles when they are moved apart from each other;

(b) a heating means comprising an electric heater rod secured to and projecting outwardly from the free end of said first handle;

(c) a hair press plate secured to and projecting outwardly from the free end of said second handle so as to be pivotally contactable with said heater rod; a power cord for supplying power to said electric heater rod;

(d) a rotary connector connected to said power cord adjacent the pivotal connection of said first and second handles, said connector being formed as a protrusion on one of said handles, the axis of rotation of said rotary connector being coaxial with a longitudinal center line between the two handles and in the same plane as said first axis, means connecting said rotary connector to said heater rod.

11. The hair iron of claim 10 in which said covers are so positioned that, when closed, the covers extend beyond the periphery of the iron to serve as a support to prevent the heater rod or press plate of the iron from contacting a surface upon which it is resting.

12. A hair iron comprising:

(a) first and second elongated handles pivotally connected together adjacent an end of each handle, the pivotal connection comprising a transverse opening through said first handle defining a pivot axis; an opening in the side of said first handle perpendicular to said pivot axis; a semicircular projection on said second handle fitting into said opening and having a pivot hole therein; a pivot pin passing through both said handles coaxial with said pivot axis and through said pivot hole and transverse opening; and a pivot pin comprising two portions, each shaped as a large headed bolt, one entering from each side of said transverse opening and threaded into each other, one of said portions having an axially inwardly projecting tongue on the inner side of its head which contacts the semi-circular projection to limit travel thereof;

(b) a heating means comprising an electric heater rod secured to and projecting outwardly from the free end of said first handle;

(c) a hair press plate secured to and projecting outwardly from the free end of said second handle so as to be pivotally contactable with said heater rod; a power cord for supplying power to said electric heater rod;

(d) a rotary connector connected to said power cord adjacent the pivotal connection of said first and second handles, said connector being formed as a protrusion on the pivotally connected end of said first handle, the axis of rotation of said rotary connector being coaxial with a longitudinal center line between the two handles, means connecting said heater rod to said rotary connector.

13. A hair iron comprising:

(a) first and second elongated handles pivotally connected together adjacent an end of each;

(b) a heating means comprising an electric heater rod secured to and projecting outwardly from the free end of said first handle;

(c) a hair press plate secured to and projecting outwardly from the free end of said second handle so as to be pivotally contactable with said heater rod; a power cord for supplying power to said electric heater rod;

(d) a rotary connector connected to said power cord adjacent the pivotal connection of said first and second handles, said connector comprising a protrusion on the end of one of said first and second handles on the opposite side of the pivotal connection of the first and second handles from the free ends thereof, the axis of rotation of said rotary connector being coaxial with a longitudinal center line between the two handles, said rotary connector protrusion comprising two semicircular projections contacting a rotatable cylindrical member to which said power cord is connected and said cylindrical member having its axis of rotation substantially on said longitudinal center line so that when said cylindrical member is rotated, the rotation takes place substantially along said longitudinal centerline, means connecting said heater rod to said rotary connector.

* * * * *